US006963239B2

(12) United States Patent
Laville et al.

(10) Patent No.: US 6,963,239 B2
(45) Date of Patent: Nov. 8, 2005

(54) DEVICE AND PROCESS FOR ADJUSTMENT OF AN OPERATING PARAMETER OF AN ANALOG ELECTRONIC CIRCUIT

(75) Inventors: Sebastien Laville, Grenoble (FR); Serge Pontarollo, Saint Martin le Vinoux (FR)

(73) Assignee: STMicroelectronics S.A. (FR)

( * ) Notice: Subject to any disclaimer, the term of this patent is extended or adjusted under 35 U.S.C. 154(b) by 0 days.

(21) Appl. No.: 10/629,342

(22) Filed: Jul. 28, 2003

(65) Prior Publication Data

US 2005/0073350 A1 Apr. 7, 2005

(30) Foreign Application Priority Data

Jul. 29, 2002 (FR) ..... 02 09615

(51) Int. Cl.[7] ..... H01H 85/00
(52) U.S. Cl. ..... 327/525; 327/540; 327/541
(58) Field of Search ..... 327/525, 526, 327/538–541, 543; 365/225.7; 323/313–315, 317

(56) References Cited

U.S. PATENT DOCUMENTS 5,450,030 A * 9/1995 Shin et al. ..... 327/525
5,808,944 A * 9/1998 Yoshitake et al. ..... 365/200
5,838,076 A * 11/1998 Zarrabian et al. ..... 307/115
6,011,428 A * 1/2000 Tsukude et al. ..... 327/541
6,281,734 B1 8/2001 McClure et al. ..... 327/308
6,424,593 B1 7/2002 Kuge et al. ..... 365/233
6,703,885 B1 * 3/2004 Fan et al. ..... 327/308

FOREIGN PATENT DOCUMENTS

| | | |
|---|---|---|
| EP | 0 410 595 | 1/1991 |
| JP | 11110067 | 4/1999 |
| JP | 11233634 | 8/1999 |
| JP | 2001202147 | 7/2001 |

* cited by examiner

*Primary Examiner*—Kenneth B. Wells
(74) *Attorney, Agent, or Firm*—Jenkens & Gilchrist, P.C.

(57) ABSTRACT

Adjustment of an operating parameter of an analog electronic circuit is effectuated through a set of adjustment resistances (22) that can be configured from outside the circuit to modulate the value of resistances (R1, R2) in the circuit and thus to adjust the value of the parameter. Fusible elements (20) each associated with one of the said adjustment resistances are selected and activated to configure the resistances of the adjustment device. A combinational logic circuit (18) receives a control signal as input applied from outside the circuit onto a terminal (C) operates to select one of the fusible elements (20) as a function of a signal applied thereto.

20 Claims, 8 Drawing Sheets

FIG.8

| Q3 | Q2 | Q1 | S1 | B2 | P5 | S4 | S5 | B6 |
|---|---|---|---|---|---|---|---|---|
| 0 | 0 | 0 | 1 | 1 | 1 | 1 | 1 | 1 |
| 0 | 0 | 1 | 1 | 1 | 1 | 1 | 1 | 1 |
| 0 | 1 | 0 | | 1 | 1 | 1 | 1 | 1 |
| 0 | 1 | 1 | 1 | | 1 | 1 | 1 | 1 |
| 1 | 0 | 0 | 1 | 1 | | 1 | 1 | 1 |
| 1 | 0 | 1 | 1 | 1 | 1 | | 1 | 1 |
| 1 | 1 | 0 | 1 | 1 | 1 | 1 | | 1 |
| 1 | 1 | 1 | 1 | 1 | 1 | 1 | 1 | |

DEVICE AND PROCESS FOR ADJUSTMENT OF AN OPERATING PARAMETER OF AN ANALOG ELECTRONIC CIRCUIT

PRIORITY CLAIM

The present application claims priority from French Application for Patent No. 02 09615 filed Jul. 29, 2002.

BACKGROUND OF THE INVENTION

1. Technical Field of the Invention

The present invention relates to the domain of analog electronic circuits. More particularly, the invention relates to a device and a process for adjustment of an operating parameter of such a circuit. One particularly attractive application of such a device and such a process relates to the adjustment of the reference voltage supplied by a reference voltage source.

2. Description of Related Art

A reference voltage source is an analog circuit that outputs a constant voltage independent of the operating temperature and the applied power supply current.

As it is conceived, the value of the voltage output by the reference voltage source is a parameter that has to be fixed very precisely. However during assembly, and particularly when the circuit is packaged, the voltage output by the circuit may drift significantly.

Reference voltage sources are provided with an adjustment device, for example a device integrated into one of the stages of the source, to compensate for this drift. This adjustment device acts by adapting the global value of resistances placed between the anode and the cathode of the circuit as a function of the voltage to be adjusted, using fusible elements that can be selectively activated.

The voltage output by the analog circuit is adjusted by selecting one or several fusible elements and by applying a sufficiently high voltage to these elements so that they break down.

These fusible elements are selected and activated using specific pins, each of which communicates with one of the fusible elements.

Thus, electronic circuits of this type do not have a standard configuration, to the extent that they include additional pins.

Furthermore, the parameter is adjusted before packaging, in other words before the parameter to be adjusted is affected by a drift. Therefore, this adjustment is made in advance and is necessarily imperfect.

There is a need to overcome these disadvantages and to provide a device and a method for adjusting an operating parameter of an analog circuit that can be integrated into a standard analog circuit and that is capable of compensating for the drift of the parameter during packaging, with improved precision.

SUMMARY OF THE INVENTION

The present invention proposes a device for the adjustment of an operating parameter of an analog electronic circuit. A set of adjustment resistances can be configured from outside the circuit to modulate the value of resistances in the circuit and thus adjust the value of the said parameter. Fusible means are provided associated with one of the said adjustment resistances and that will be selected and activated to configure the resistances of the adjustment device.

According to one general feature of this adjustment device, it also includes a combinational logic circuit that receives a control signal as input applied from outside the circuit onto a terminal of this circuit and adapted to select one of the fusible means as a function of a signal applied to it.

According to another special feature of this device, it comprises a count circuit connected to the logic circuit and to which the control signal is applied as input, to increment the count in the count circuit forming an addressing signal of the fusible means, at each transition of this control signal.

It also comprises a circuit for controlling activation and de-activation of the electronic circuit and the adjustment device connected between the said terminal of the circuit and the count circuit and comprising a stage to control activation and de-activation of the electronic circuit and a stage to generate a clock signal controlling the count circuit.

According to one embodiment, each control stage comprises a set of diodes in series connected between the said terminal of the analog electrical circuit and a switching element controlled as a function of the voltage applied to the said terminal of the circuit, the said diodes jointly defining a threshold voltage for activation of the switching element.

According to one embodiment, each control stage is provided with a hysteresis circuit.

According to one specific feature of the count circuit, the count circuit comprises a set of count flip flops and a set of logical gates at the input to the count circuit so as to accelerate transitions of the control signal.

For example, the adjustment resistances are arranged in series with the corresponding fusible elements, with each assembly being composed of an adjustment resistance and a fusible element being arranged in parallel on a resistance of this circuit to be adjusted.

According to another specific feature of the device according to the invention, each of the fusible elements is formed from a MOS transistor with a parasite two-pole transistor.

According to one advantageous embodiment, it comprises means of for adjusting a breakdown voltage threshold of the fusible elements.

For example, these adjustment means may comprise a resistance bridge arranged between the gate grid and the source and between the gate and the drain of each MOS transistor.

The invention also proposes an analog electronic circuit, for example a reference voltage source, which comprises an adjustment device like that defined above.

The invention also proposes a process for adjustment of an operating parameter of an analog electronic circuit, comprising a set of adjustment resistances configurable from the outside of the circuit to modulate the value of circuit resistances and thus to adjust the value of the said parameter, and fusible means each associated with one of the said adjustment resistances and that will be selected and activated to configure the resistances of the adjustment device, this process being designed for use with an adjustment device like that defined above.

This process comprises the following steps:

measure the circuit operating parameter;

set a count circuit to zero;

set the circuit power supply voltage above a first threshold value so as to de-activate the circuit;

generate a device control clock signal so as to increment the count circuit to a count level corresponding to one of the fusible means;

decode the clock signal and select the corresponding fusible means; and increase the level of the power supply voltage up to the breakdown voltage of the fusible means.

BRIEF DESCRIPTION OF THE DRAWINGS

A more complete understanding of the method and apparatus of the present invention may be acquired by reference to the following Detailed Description when taken in conjunction with the accompanying Drawings wherein:

FIG. 8 is a truth table that generates the combinational logic circuit;

DETAILED DESCRIPTION OF THE DRAWINGS

Figure 1:
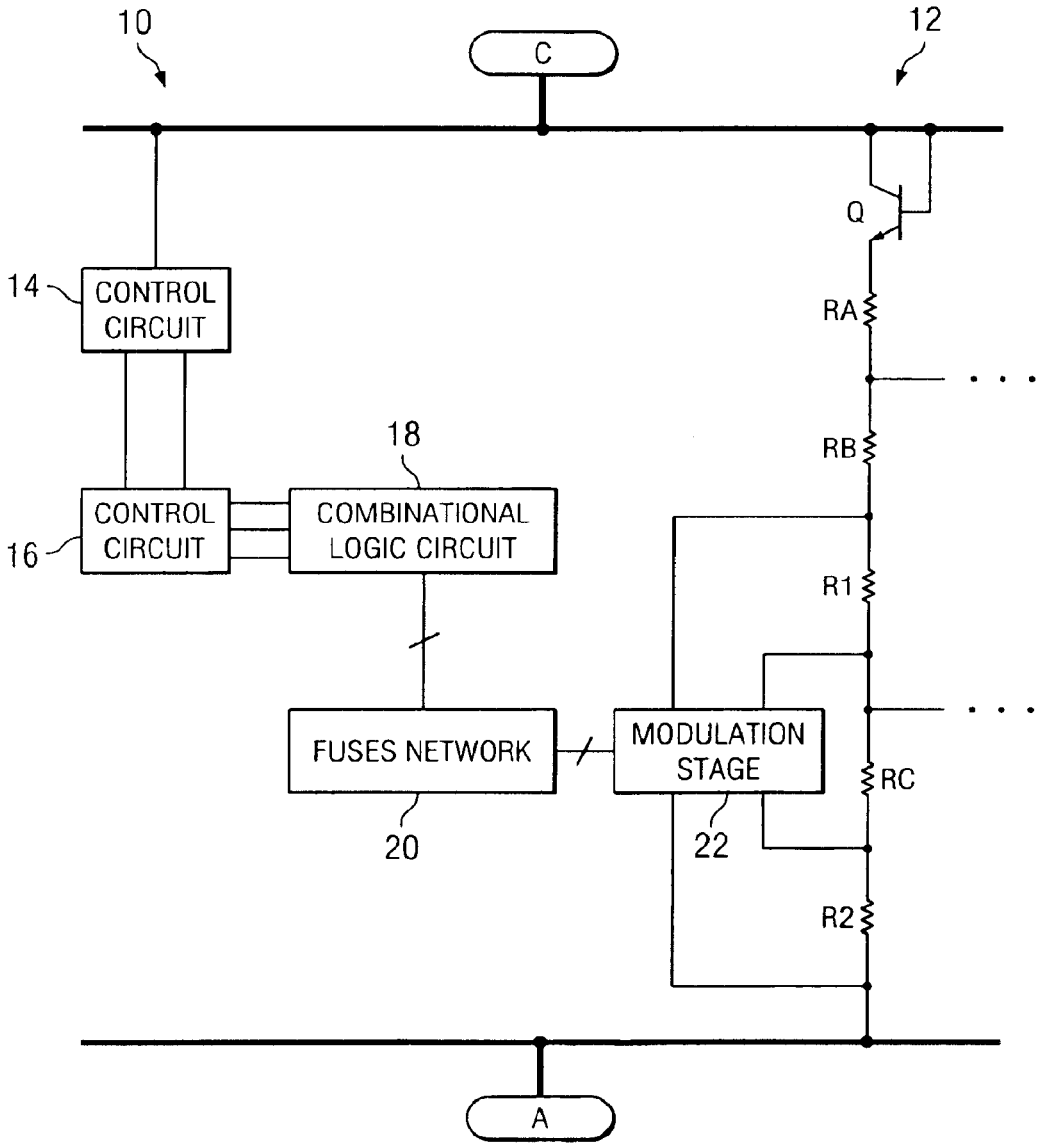
FIG. 1 is a block diagram illustrating the structure of an adjustment device according to the invention.

FIG. 1 shows the general structure of a device for adjustment of an operating parameter of an analog electronic circuit, denoted by the general numeric reference 10.

In the example embodiment shown, this adjustment device is designed to adjust the reference voltage supplied by a reference voltage source, which must output a fixed voltage independently of its operating temperature or its power supply current.

The invention could also be equally applicable to any type of analog electronic circuit for which an operating parameter has to be precisely adjusted, independently of its operating conditions, such as an operational amplifier or a comparator for which the output voltage must be precisely defined, or an oscillator for which the frequency has to be precisely adjusted, etc.

As can be seen in FIG. 1, the adjustment device 10 will be placed in parallel on a stage 12 of the reference voltage source, which comprises a resistive bridge composed of resistances $R_A$, $R_B$, $R_C$ and $R_1$, $R_2$ associated with a transistor Q, the assembly being connected between a cathode C and an anode A that form the external terminals of the reference voltage source.

More particularly, the adjustment device 10 is arranged in parallel on some of the resistances, denoted as numeric references $R_1$ and $R_2$, in order to modulate their resistance value to adjust the reference voltage output by the source, so as to correct the drifts generated during assembly of the circuit by modulating the global value of the resistive bridge between the anode and the cathode.

Figure 2:
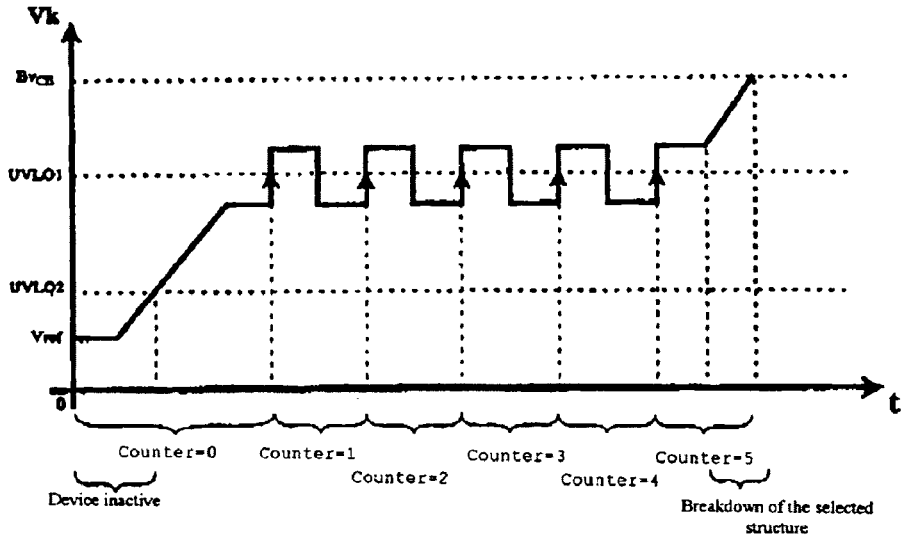
FIG. 2 is an example of a time diagram showing the variation of the control signal Vc applied to the cathode of the reference voltage source, as a function of time.

The adjustment device 10 essentially comprises an activation and de-activation control circuit 14 for the source 12 and the adjustment circuit 10 that is connected to the cathode C; a count circuit 16 connected to the activation and de-activation control circuit 14, that will be incremented on each transition of a control signal visible in FIG. 2; a combinational logic circuit 18 that decodes the output from the count circuit 16; a network of fusible elements 20 that can be selectively activated under the control of the logic circuit 18 as a function of the output from the count circuit 16; and a modulation stage 22 modulating resistances $R_1$ and $R_2$ composed of a set of variable resistances each placed in series with a fusible element in the fuses network 20 and in parallel on one of the resistances $R_1$ and $R_2$ to be adjusted.

As can be seen in this FIG. 1, the adjustment device 10 is connected between the cathode C and the resistances $R_1$ and $R_2$. Thus, it uses standard pins of the voltage source and can operate without the need for any special pins. The control signal applied to the cathode of the source is a means firstly of selecting fusible elements and adjustment resistances for resistances $R_1$ and $R_2$, and secondly of provoking the selective connection of adjustment resistances in parallel on resistances $R_1$ and $R_2$ by taking action on fusible elements, external to the circuit, after packaging.

As it is conceived, during operation of the reference voltage source, the adjustment device 10 must be inactive. In this case, a current is injected through the cathode C that outputs a constant voltage called the "reference" voltage. On the other hand, in reference voltage adjustment mode, the adjustment device 10 must be active and the reference voltage source 12 must be inactive. The cathode C is then used as the power supply for the adjustment device.

Also with reference to FIG. 2, the operating principle for this adjustment device is as follows. For a power supply voltage applied to the cathode C less than a first threshold voltage UVLO2 (Under Voltage Lock out 2), the adjustment device 10 is inactive, the output from the count circuit 16 is equal to zero and the fusible elements in network 20 are inactive, in other words they are conducting. If the power supply voltage exceeds this first threshold value UVLO2, the output stage of the reference voltage source is disabled and the adjustment device 10 is activated. In order to select the fusible elements of the fuses network 20 and the corresponding adjustment resistances of stage 22, a clock circuit is generated around a power supply voltage UVLO1 that increments the count circuit 16. The counter level is then defined by the number of clock periods completed. This number of periods is then decoded by the combinational logic circuit 18 so that one or several fusible elements and the corresponding resistances can be selected. Once the fusible element has been selected, the voltage of cathode C is increased until the breakdown voltage of the fusible element. Thus, the value of the resistances $R_1$ or $R_2$ is modified to adjust the voltage output by the reference voltage source accordingly.

When the reference voltage has thus been adjusted in this manner, the circuit may be used as the reference voltage source.

As will be described later, steps will be taken to prevent the activation voltage of fusible elements in the fuses network 20 from being greater than the maximum allowable voltage depending on the technology used by the voltage source, in order to avoid damaging the circuit.

Figure 3:
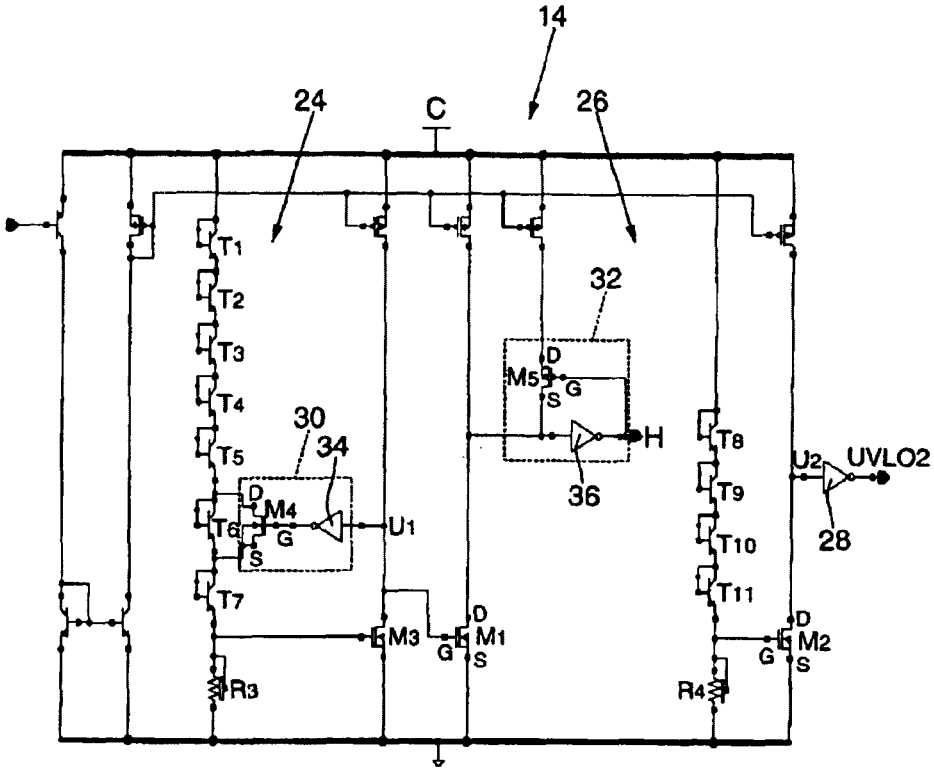
FIG. 3 is a diagram illustrating the structure of the activation and de-activation control circuit for the electronic circuit and the adjustment device.

We will now describe the structure of the activation and de-activation control circuit for the reference voltage source of the adjustment device 10, with reference to FIG. 3. This control circuit 14 performs two functions. The first function is to inhibit the adjustment device during normal operation of the reference voltage source and to set the count circuit to zero. The second function is to format the control signal, in other words the clock signal applied to the count circuit.

As can be seen in FIG. 3, the activation and de-activation control circuit 14 comprises a first stage 24 that generates the clock signal H that will be used in the count circuit, and a second activation and de-activation control stage 26 of the reference voltage source, that outputs the first threshold value UVLO2.

Each of these stages comprises a set of diodes, composed of the p-n junctions of the two-pole transistors, namely T1, T2 and T3, T4, T5, T6 and T7; and T8, T9, T10, T11 respectively.

Concerning the network of diodes T1 to T7 in the first stage 24, they are connected to the cathode C and to the ground through a resistance R3. The two-pole transistor T6 forming one of the diodes in the diodes network is connected to a gate grid G of a transistor M1 through a first hysteresis circuit 30, the drain D of this MOS transistor M1 outputting the clock signal H through a second hysteresis circuit 32.

Similarly, diodes T8 to T11 in the second stage 26 are connected firstly to the cathode C and secondly to the ground through a resistance R4. The common terminal between the transistor T11 and the resistance R4 is connected to the gate G of a MOS transistor M2. The drain D of this MOS transistor M2 is connected to a node U2, which outputs the threshold voltage UVLO2 through an inverter gate 28.

This circuit 14 operates as follows.

When the power supply voltage applied to the cathode C is less than the threshold voltage UVLO2, the network of diodes composed of transistors T8 to T11 is blocked. The transistor gate M2 is then connected to the ground through the resistance R4. The voltage of node U2 is then at a high level, and the output from the inverter gate 28 is at a low level. This voltage then controls the count circuit 16 through an appropriate conventional type of stage, so as to reset the counters in the circuit to 0. The adjustment device is then inactive. For a power supply voltage greater than the threshold voltage UVLO2, the diodes composed of transistors T8 to T11 are conducting. The MOS transistor M2 that operates under saturated conditions, connects node U2 to the ground. The device is then active and the reference voltage source is deactivated.

Furthermore, when the power supply voltage output to the cathode C is less than the voltage level UVLO1, the diodes formed by transistors T1 to T7 are not conducting. The gate G of transistor M1 is made high through a MOS transistor M3 placed between the cathode and the anode, the gate of which is connected to the common node between the transistor T7 and the resistance R3 and that operates under non-conducting conditions. The node U1 is then set to a high level.

If the power supply voltage is greater than the voltage UVLO1, the diodes formed by transistors T1 to T7 are conducting. The transistor M3 that operates under linear conditions connects node U1 to the ground. The counter is then incremented.

Figure 5:
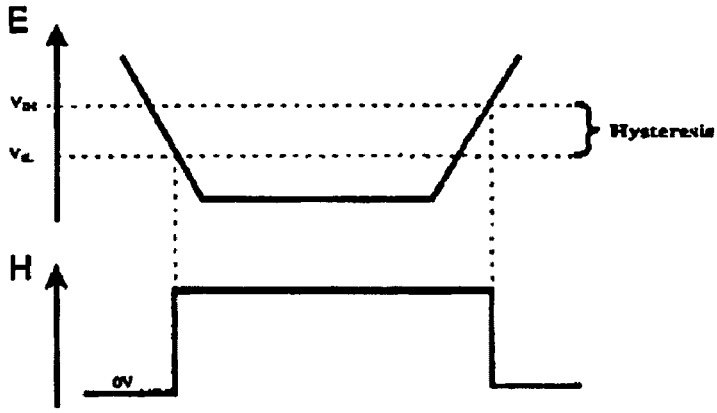
FIG. 5 shows curves illustrating the behavior of the activation and de-activation control circuit in FIG. 3.

As mentioned above, hysteresis circuits 30 and 32 are used to create a hysteresis in operation of this control circuit 14, as can be seen in FIG. 5.

The hysteresis circuit 30 associated with the first stage 24 comprises a MOS transistor M4 associated with one of the diodes, namely the diode composed of the two-pole transistor T6, and an inverter switch 34 placed between the node U1 and the MOS transistor M4.

Thus, with this arrangement, the node U1 switches from the high level to the low level when all diodes T1 to T7 are conducting. On the other hand, it will change from the low level to the high level when diodes denoted T1 to T6 are conducting, in other words for a lower power supply voltage. When node U1 is at a low level, the MOS transistor M4 is conducting, the diode denoted by the reference T6 is short circuited, which means that U1 will change to a lower voltage. This hysteresis was created to overcome a possible variation due to the noise present on the power supply voltage that generates the counter clock signal, which could generate count errors within the count circuit 16.

Figure 4A:
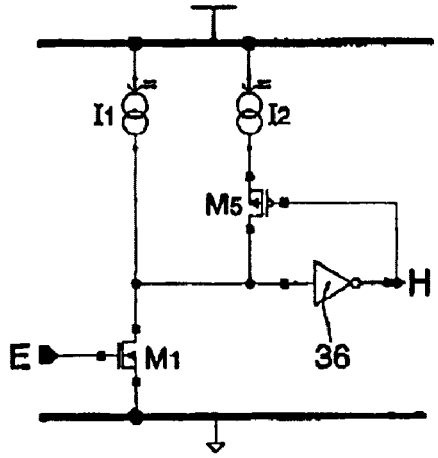
FIGS. 4*a* and 4*b* are detailed views of the circuit in FIG. 3, illustrating the hysteresis circuit.
Figure 4B:
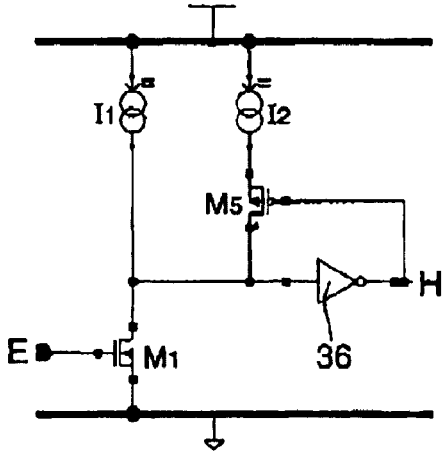

FIGS. 4*a* and 4*b* show a similar circuit 32 that is also used to generate a hysteresis. On these diagrams, the elements of the circuit in FIG. 3 are shown in the form of current sources 11 and 12. FIGS. 4*a* and 4*b* correspond to two different states of the circuit in FIG. 3.

This circuit 32 comprises a MOS transistor M5, the source S of which is connected to the cathode C and the drain of which is connected to the MOS transistor M1. An inverter switch 36 is connected to the drain of the transistor M5 and outputs the clock signal H. The gate of the transistor M5 is connected to the output from the inverter switch 36.

Also with reference to FIG. 5, when the input E to the MOS transistor M1 changes from a high level to a low level (FIGS. 4*a* to 4*b*), the transistor M5 allows a very low current to pass, due to the delay in switching of the inverter switch 36. On the other hand, in the case in which the input changes from a low level to a high level (FIGS. 4*b* to 4*a*), the MOS transistor M5 allows a current to pass that is additional to current I1, thus enabling an offset of the switching threshold. Thus, a hysteresis is created.

The equations for the hysteresis thresholds $V_{IH}$ and $V_{IL}$ are defined as follows:

$$V_{IH} = Vt_n + \sqrt{\frac{I_1 + I_{2IH}}{\left(\frac{W}{L}\right)_n \cdot \frac{\mu Cox}{2}}} \tag{1}$$

$$V_{IL} = Vt_n + \sqrt{\frac{I_1 + I_{2IL}}{\left(\frac{W}{L}\right)_n \cdot \frac{\mu Cox}{2}}} \tag{2}$$

in which:

W/L denotes the ratio of the transistor dimensions;

$Vt_n$ denotes the threshold voltage of the MOS;

$\mu$ denotes the mobility of the carriers; and

Cox denotes the oxide capacitance.

Figure 6:
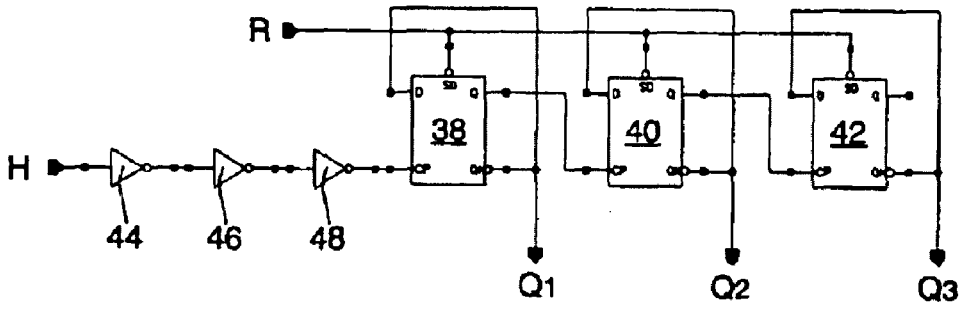
FIG. 6 is a diagram illustrating the structure of the count circuit.

With reference now to FIG. 6, the count circuit is composed of a combination of three flip flops D 38, 40 and 42. This structure forms an asynchronous modulo 8 counter. With three flip-flops D, there are three outputs Q1, Q2 and Q3. These flip flops 38, 40 and 42 receive a clock signal H output from the control circuit 14, after shaping, through three inverter switches 44, 46 and 48 that are intended to accelerate the clock signal transition times. A relatively fast clock is necessary for good counting. A zeroing input R zeroes all outputs Q1, Q2 and Q3 under the control of signal UVLO2.

As mentioned above, the outputs from the count circuit Q1, Q2 and Q3 will be decoded by the combinational logic circuit 18 to select the fusible elements of the network 20 and the corresponding adjustment resistances of the modulation stage 22 to adjust the global value of the resistances $R_1$ and $R_2$ of the reference voltage source.

In the example embodiment considered, the fuses network comprises six fusible elements and the modulation stage 22 essentially comprises six resistances associated with the corresponding fusible elements of the network 20 and grouped in the form of two sets of three resistances, each modulating one of the resistances $R_1$ and $R_2$.

Thus, the combinational logic circuit has six outputs $S_1$ to $S_6$, each selecting one of the fusible elements and one of the resistances of the modulation stage 22.

Figure 7:
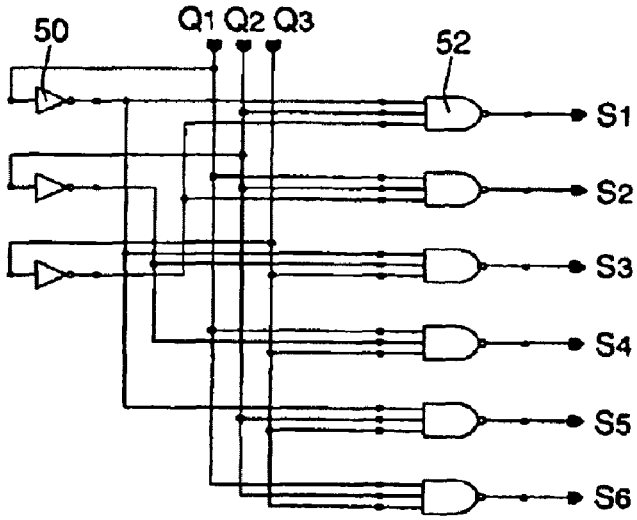
FIG. 7 is a diagram illustrating the composition of the combinational logic circuit.

FIGS. 7 and 8 show an example embodiment of the combinational logic circuit designed to generate selection signals S1 to S6, calculated from the truth table shown in FIG. 8.

Thus, in this example, the signals S1, S2, S3, S4, S5 and S6 satisfy the following relations:

$$S1 = \overline{\overline{Q3}\cdot Q2\cdot\overline{Q1}} \quad S2 = \overline{\overline{Q3}\cdot Q2\cdot Q1} \quad S3 = \overline{Q3\cdot\overline{Q2}\cdot\overline{Q1}} \tag{3}$$

$$S4 = \overline{Q3\cdot\overline{Q2}\cdot Q1} \quad S5 = \overline{Q3\cdot Q2\cdot\overline{Q1}} \quad S6 = \overline{\overline{Q3}\cdot\overline{Q2}\cdot\overline{Q1}} \tag{4}$$

Figure 8A:
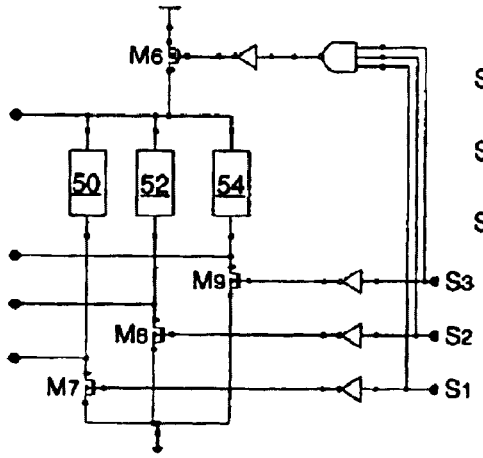
FIGS. 8*a* and 8*b* show the structure of the fusible means selection circuit.
Figure 8B:
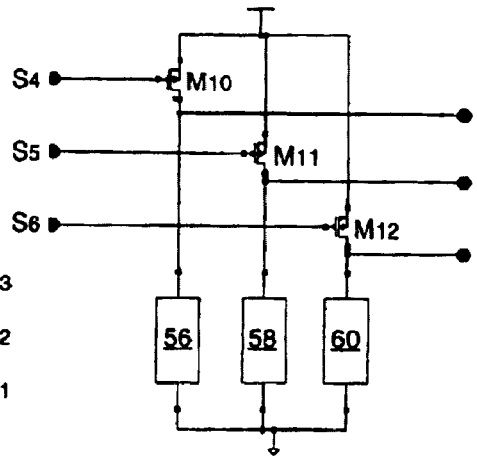
Figure 9:
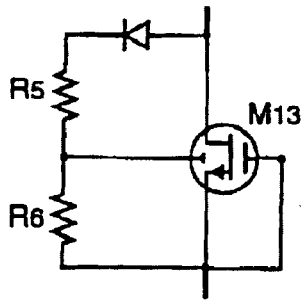
FIG. 9 illustrates the composition of the fusible means used to modulate the resistance values of the analog electronic circuit.

We will now describe the structure of the fuses network 20 used to adjust the value of resistances $R_1$ and $R_2$, with reference to FIGS. 8*a*, 8*b* and 9.

FIG. 8*a* shows a structure used to adjust the value of the resistance $R_1$, and FIG. 8*b* shows a structure used to adjust the value of resistance $R_2$.

With reference firstly to FIG. 8*a*, this portion of the circuit receives inputs consisting of signals S1, S2 and S3 output from the combinational logic circuit 18. It comprises a set of three fusible elements 50, 52 and 54 and a set of control transistors, namely a PMOS transistor M6 and NMOS control transistors M7, M8 and M9. These transistors are used to select one of the fusible elements 50, 52 and 54 as a function of the signals S1, S2 and S3 output from the logic circuit 18, and consequently to direct the voltage present on the cathode C to cause breakdown of the selected fusible element.

The circuit element shown in FIG. 8*b* has a similar structure and also comprises fusible elements 56, 58 and 60 associated with the NMOS control transistors M10, M11 and M12 to select one of the fusible elements 56, 58 and 60 as a function of the control signals S6, S7 and S8 output from the logic circuit 18.

However, this circuit is adapted to the configuration of the resistance $R_2$ to be modulated, which has its potential referenced to the ground.

Note that the control transistors are sized to have an equivalent resistance of about 20 ohms. In the case of the structure shown in FIG. 8*a*, in the conducting state, the equivalent resistance Ron of the PMOS control transistor M6 is three times higher than the equivalent resistance of the MOS control transistors M7, M8 and M9.

The equivalent resistance Ron of the transistors is given by the following relation:

$$Ron = \frac{1}{\frac{\mu Cox}{(1+\theta(V_{gs}-V_{sp}))}\cdot\frac{W}{L}(V_{gs}-V_{sp})} \tag{5}$$

Referring now to FIG. 9, it can be seen that each fusible element is made from an NMOS transistor M13. This component has a parasite two-pole transistor which can be used to make a short circuit, which corresponds to a broken down state of the MOS transistor M13, or an open circuit, which corresponds to a non-conducting state of the MOS transistor M13.

It will be noted that a resistive bridge composed of a combination of resistances $R_5$ and $R_6$ in series, is arranged between the drain and the source of transistor M13, so as to lower the breakdown voltage of this component in order to make the operation of fuses compatible with the technology used in the reference voltage source, in order to prevent deterioration of this reference voltage source.

Figure 10:
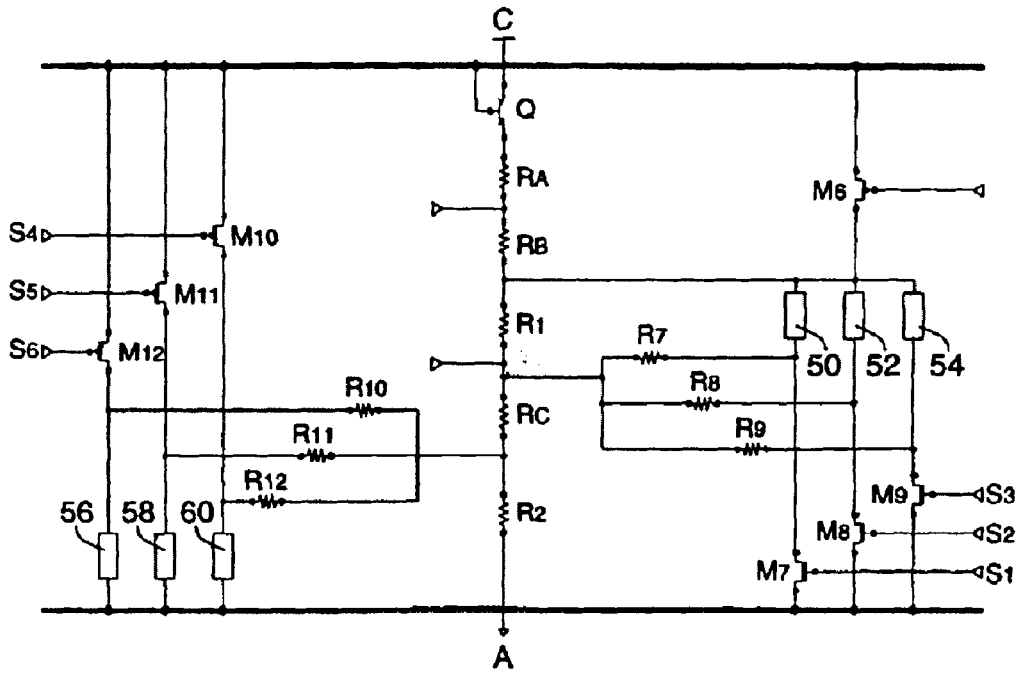
FIG. 10 is a general diagram showing the selection and activation stage of the fusible elements.

Now with reference to FIG. 10, on which the constituents of the fuses network 20 and their control transistors M6 to M12 have been shown, the adjustment resistances $R_7$, $R_8$, $R_9$, $R_{10}$, $R_{11}$ and $R_{12}$ are arranged in series with a corresponding fusible element 50, 52, 54, 56, 58 and 60. The choice of the values of these resistances depends on the global dispersion of the reference voltage and the precision to be obtained.

Considering the fusible elements and the corresponding resistances to be used for adjustment of the value of the resistance $R_1$ (right part of the diagram in FIG. 10), it can be seen that the resistances $R_7$, $R_8$ and $R_9$, each associated with a corresponding fusible element 50, 52 and 54, are each placed in parallel on the resistance $R_1$. Thus, the total value of the resistance $R_1$ can be added by adding one of the resistances $R_7$, $R_8$, or $R_9$ onto it in parallel, by selectively breaking down the fusible elements 50, 52 and 54.

Similarly, action can be taken on the fusible elements 56, 58 and 60 to connect one of the resistances $R_{10}$, $R_{11}$ and $R_{12}$ (left part of the circuit in FIG. 10) in parallel on resistance $R_2$.

As it is conceived, the invention that has just been described provides a means of precisely adjusting the reference voltage output by a voltage source, precisely, without the need to use special terminals to select the fusible elements that will be used to adjust the voltage, and therefore keeping a standard configuration for the electronic circuit provided with such an adjustment device.

In this respect, it will be noted that with this invention, it is possible to obtain a precision of the supplied reference voltage of the order of 0.5% for 100% of adjusted circuits.

Finally, it should be noted that the invention is not limited to the embodiment described. As mentioned above, the invention is equally applicable to any analog electronic circuit for which such an operating parameter must be precisely adjusted, such as an operational amplifier, an oscillator, a comparator, etc.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A device for the adjustment of an operating parameter of an analog electronic circuit which includes circuit resistances, comprising:

a plurality of adjustment resistances that are configured to modulate the value of the circuit resistances and thus to adjust the value of the said parameter;

fusible means each connected with one of the adjustment resistances and that are selected and activated to configure the adjustment resistances so as to modulate the value of the circuit resistances; and a logic circuit that receives a control signal as input applied from outside the analog electronic circuit at a terminal thereof and adapted to select one of the fusible means for activation; and wherein the logic circuit comprises:

a count circuit connected to a combinational logic circuit the count circuit functioning responsive to the control signal to increment a count forming an addressing signal that is decoded by the combinational logic circuit to identify one of the fusible means; and a control circuit for controlling activation and de-activation of the analog electronic circuit and the adjustment device connected between the terminal of the analog electronic circuit and the count circuit, the control circuit including a first stage to control activation and de-activation of the analog electronic circuit and a second stage to generate a clock signal controlling the count circuit.

2. The device according to claim 1, wherein each of the first and second stage comprises a plurality of diodes in series connected between the terminal of the analog electronic circuit and a switching element controlled as a function of the voltage applied to the terminal, the diodes jointly defining a threshold voltage for activation of the switching element.

3. The device according to claim 1, wherein each of the first and second stage is provided with a hysteresis circuit.

4. The device according to claim 1, wherein the count circuit comprises a plurality of count flip flops and a plurality of logical gates at the input to the count circuit so as to accelerate transitions of the control signal.

5. The device according to claim 1, wherein each of the fusible means is formed from a MOS transistor with a parasite two-pole transistor.

6. A device for the adjustment of an operating parameter of an analog electronic circuit which includes circuit resistances, comprising:

a plurality of adjustment resistances that are configured to modulate the value of the circuit resistances and thus to adjust the value of the parameter;

fusible means each connected with one of the adjustment resistances and that are selected and activated to configure the adjustment resistances so as to modulate the value of the circuit resistances, and a logic circuit that receives a control signal as input applied from outside the analog electronic circuit at a terminal thereof and adapted to select one of the fusible means for activation, wherein each adjustment resistance is arranged in series with a corresponding fusible element, with each series arranged adjustment resistance and fusible element being arranged in parallel with one of the circuit resistances to be adjusted.

7. A device for the adjustment of an operating parameter of an analog electronic circuit which includes circuit resistances, comprising:

a plurality of adjustment resistances that are configured to modulate the value of the circuit resistances and thus to adjust the value of the parameter:

fusible means each connected with one of the adjustment resistances and that are selected and activated to configure the adjustment resistances so as to modulate the value of the circuit resistances;

a logic circuit that receives a control signal as input applied from outside the analog electronic circuit at a terminal thereof and adapted to select one of the fusible means for activation, and means for adjusting a breakdown voltage threshold of the fusible means.

8. The device according to claim 7, wherein each of the fusible means is formed from a MOS transistor with a parasite two-pole transistor, and wherein the means for adjusting comprise a resistance bridge arranged between the gate and the source of each MOS transistor.

9. An analog electronic circuit, comprising:

first resistances that are modulated to adjust the value of an operating parameter of the analog electronic circuit;

second resistances that are configured responsive to a control signal received from outside the analog electronic circuit to modulate the value of the first resistances;

fuse elements each connected with one of the second resistances and operable to selectively connect the second resistances in parallel with corresponding first resistances; and a logic circuit that selects fuse elements responsive to the received control signal and effectuate the selective connection of the second resistances in parallel with corresponding first resistances so as to adjust the operating parameter value by changing an effective resistance value.

10. The analog electronic circuit according to claim 9, wherein the circuit functions as a reference voltage source.

11. A process for adjusting an operating parameter of an analog electronic circuit, comprising:

setting a counter to zero;

setting a power supply voltage for the analog electronic circuit above a first threshold value so as to de-activate the analog electronic circuit;

generating a device control clock signal so as to increment the counter to a count level corresponding to a selected one of a plurality of fusible elements, that fusible element being connected to a resistance within the de-activated analog electronic circuit whose value has an effect on the operating parameter;

decoding the count level to select the corresponding fusible element; and increasing the level of the power supply voltage up to the breakdown voltage of the fusible element and thus alter the value of the resistance and make an adjustment to the operating parameter.

12. A circuit, comprising a first resistor connected between a first and a second node;

a modulation resistance circuit comprising a plurality of second resistors each in series with a corresponding one of a plurality of fusible elements, the modulation resistance circuit connected in parallel with the first resistor between the first and second node;

a logic circuit operable to select at least one of the fusible elements to be blown thus removing the corresponding second resistor from the parallel connection so as to adjust a resistance between the first and second nodes; and an activation control circuit that controls when the modulation resistance circuit and logic circuit are active to blow selected fusible elements wherein the activation control circuit activates in response to a power supply voltage increasing to exceed a certain threshold.

13. The circuit of claim 12 wherein the logic circuit comprises:

a combinational logic circuit that decodes an addressing signal to make a selection as to which the fusible element is to be blown.

14. The circuit of claim 13 wherein the logic circuit further comprises:

a counter circuit which increments responsive to a control signal and outputs a counter value as the addressing signal.

15. The circuit of claim 12 wherein the selected fusible element is blown when the power supply voltage further increases to exceed fusible element breakdown voltage.

16. An analog circuit having an operating parameter whose value is determined by an effective resistance value present between a first and a second node, comprising:

a variable resistance circuit connected between the first and second node and comprising a plurality of resistors each in series with a corresponding one of a plurality of fusible elements;

a logic circuit operable to select at least one of the fusible elements to be blown thus removing the corresponding resistor from the variable resistance circuit connection so as to adjust the effective resistance value between the first and second nodes; and an activation control circuit that controls when the modulation resistance circuit and logic circuit are active to blow selected fusible elements wherein the activation control circuit activates in response to a power supply voltage increasing to exceed a certin threshold.

17. The analog circuit of claim 16 wherein the analog circuit is a reference voltage source and the operating parameter is a reference voltage.

18. The analog circuit of claim 16 wherein the logic circuit comprises:

a combinational logic circuit that decodes an addressing signal to select the fusible element to be blown.

19. The analog circuit of claim 18 wherein the logic circuit further comprises:

a counter circuit which increments responsive to a control signal and outputs a counter value as the addressing signal.

20. The analog circuit of claim 16 wherein the selected fusible element is blown when the power supply voltage further increases to exceed fusible element breakdown voltage.

* * * * *

UNITED STATES PATENT AND TRADEMARK OFFICE

CERTIFICATE OF CORRECTION

PATENT NO. : 6,963,239 B2
APPLICATION NO. : 10/629342
DATED : November 8, 2005
INVENTOR(S) : Sébastien Laville et al.

It is certified that error appears in the above-identified patent and that said Letters Patent is hereby corrected as shown below:

| | |
|---|---|
| Column 2, line 40 | Replace "means of for"<br>With --means for-- |
| Column 2, line 43 | Replace "the gate grid"<br>With --the gate-- |
| Column 5, line 22 | Replace "to a gate grid G"<br>With --to a gate G-- |
| Column 8, line 61<br>Claim 1 | Replace "of the said parameter;"<br>With--of the parameter;-- |
| Column 9, line 43,<br>Claim 6 | Replace "resistances,"<br>With --resistances;-- |
| Column 9, line 47,<br>Claim 6 | Replace "activation,"<br>With --activation;-- |
| Column 9, line 59,<br>Claim 7 | Replace "parameter:"<br>With --parameter;-- |

UNITED STATES PATENT AND TRADEMARK OFFICE

CERTIFICATE OF CORRECTION

PATENT NO. : 6,963,239 B2
APPLICATION NO. : 10/629342
DATED : November 8, 2005
INVENTOR(S) : Sébastien Laville et al.

It is certified that error appears in the above-identified patent and that said Letters Patent is hereby corrected as shown below:

| | |
|---|---|
| Column 9, line 67,<br>Claim 7 | Replace "activation,"<br>With --activation;-- |
| Column 10, line 66,<br>Claim 13 | Replace "to which the fusible element"<br>With --to which fusible element is-- |
| Column 12, line 3,<br>Claim 16 | Replace "certin"<br>With --certain-- |

Signed and Sealed this

Eleventh Day of July, 2006

JON W. DUDAS
*Director of the United States Patent and Trademark Office*